US006739831B2

(12) United States Patent
Hsu et al.

(10) Patent No.: US 6,739,831 B2
(45) Date of Patent: May 25, 2004

(54) COOLING DEVICE FOR PROJECTOR

(75) Inventors: Nien-Hui Hsu, Hsin-Chu (TW); Bor-Bin Chou, Hsin-Chu (TW); Shang-Hsuang Wu, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 76 days.

(21) Appl. No.: 10/064,187

(22) Filed: Jun. 20, 2002

(65) Prior Publication Data

US 2002/0197158 A1 Dec. 26, 2002

(30) Foreign Application Priority Data

Jun. 22, 2001 (TW) ..... 90210604 U

(51) Int. Cl.[7] ..... F04D 13/12

(52) U.S. Cl. ..... 415/60; 415/66; 415/175; 353/58; 353/61

(58) Field of Search ..... 415/60, 62, 66, 415/67, 175; 353/58, 60, 61, 119, 57

(56) References Cited

U.S. PATENT DOCUMENTS 3,180,981 A * 4/1965 Ulffers ..... 362/294
4,925,295 A * 5/1990 Ogawa et al. ..... 353/57
6,254,238 B1 * 7/2001 Takamatsu ..... 353/61
6,443,575 B1 * 9/2002 Miyamoto et al. ..... 353/58

FOREIGN PATENT DOCUMENTS

JP 2001242434 A * 9/2001 ..... G02F/1/13

* cited by examiner

*Primary Examiner*—Ninh H. Nguyen
(74) *Attorney, Agent, or Firm*—Winston Hsu

(57) ABSTRACT

A cooling device for projector, comprising a light source, an exhaust fan, an air directing fan, an air duct, air inlet windows, an optical engine, a circuit board, a light cut, and a power supply to constitute a projector device with high brightness and high contrast. The projector includes a design that directs hot air flow directly into fan blades of an exhaust fan, thereby effectively reducing adverse effects and solving problems of conventional technology, such as failure to direct hot air flow into the fan blades of the exhaust fan, resulting in excessively high average temperature in the fan hub area that is in alignment with the hot air current, and high working temperature of motor bearings, control circuits, rotors and stators in the fan hub, so that the fan hub can be operating under lower temperatures, thereby enhancing normal performance, effective working life and reliability of the fan and the projector.

6 Claims, 9 Drawing Sheets

COOLING DEVICE FOR PROJECTOR

BACKGROUND OF INVENTION

1. Field of the Invention

The invention relates to a cooling device for a projector, and particularly to a cooling device that direct hot air directly into fan blades to reduce temperature of fan hub.

2. Description of the Prior Art

Please refer to FIG. 1 that illustrates a prior art of projector 10, comprising a light source 121 of a light unit 12 inside a casing 11, the light source 121 creating a high-brightness and high-contrast projecting light ray 122 when acted on by an optical engine 13*m*. A light cut 123 installed on the upper side of the light unit 12 to obstruct the light source 121 of the light unit 12. In the prior art, heated air is subject to the action of a first fan 157, air entering the projector 10 through a first air inlet window 151 becomes a first hot current 153, which after passing a first printed circuit board 141 is separated into a third hot current 155 and a fourth hot current 156. The third hot current 155 passing a first fan 157 and fan blades 1572 is exhausted out of the projector 10, and the fourth hot current 156 is directed through the third fan 162 into the light source heat exhausting unit 16. On the other hand, when subjected to action by the second fan 158, air enters through the second air inlet window 152 into the projector 10, creating a second hot current 154. The second hot current 154 respectively passes an optical engine 13, a second printed circuit board 142 and a light unit 12, then through a plurality of fan blades 1582 of the second fan 158, finally out of the projector 10.

Due to the action of the second fan 158, the fourth hot current 156 directed through the third fan 162 into the light source heat exhausting unit 16 passes an air duct 161 to absorb the heat generated by the light source 121, so the temperature of the fourth hot current 156 rises rapidly. After passing the light cut 123, the fourth hot current 156 in the prior art of projector 10 is squarely aligned with the second fan 158, then the second hot current 154 is exhausted out of the projector 10 by the action of the fan blades 1582 of the second fan 158.

A shortcoming in the prior art of projector 10 lies in that the heat radiating direction of the fourth hot current 156 is squarely in alignment with the second fan 158 or the second fan hub 1581. The heat generated by the light source 121 of the light unit 12 is the highest in the projector 10, so the heat carried by the fourth hot current 156 after passing the light cut 123 is also the highest. Accordingly, when the fourth hot current 156 exhaust heat directly against the second fan hub 1581, the heat will be collected at the front of the second fan hub 1581 before it passes a plurality of second fan blades 1582 and out of the projector 10, forming a higher average temperature at the front of the second fan hub 1581. As shown in FIG. 5, when the prior art of the projector 10 is operating under room temperature using a light source 12 of approximately 130 Watt, the air temperature at 1 mm position 159 to the front of the center of the second fan hub 1581 will reach as high as 206.6 degrees Fahrenheit, which is higher than the maximum operating temperature of 194 degrees Fahrenheit for the second fan 158, resulting in adverse effects to the motor bearings, control circuits, rotors, stators and such key components in the hub of the second fan 158, thereby reducing the working life and reliability of the second fan 158.

As shown in FIG. 2 that illustrates another prior art of projector 20, comprising a casing 21, a light unit 22, a light source 221, an optical engine 23, a light cut 223, a first printed circuit board 241, a second printed circuit board 242, a cooling device 25, a first air inlet window 251, a second air inlet window 252, a first fan 257, a light source heat exhausting unit 26, a third fan 262, an air outlet 263 and an air inlet 261, which are the same as the first prior art, but different in that the second fan 258, the fan hub 2581 and the fan blades 2582 are installed at a rear part of the light source 221. It has the shortcoming that the heat carried by the fourth hot current 256 is also the highest. As a result, when heat is exhausted in a lower right direction from a specified distance between the fourth hot current 256 and the second fan 258, the heat will be collected at the front of the second fan hub 2581 before passing the second fan blades 2582 and out of the projector 20, forming a higher average temperature at the front of the second fan hub 2581, bringing adverse effects to the motor bearings, control circuits, rotors, stators and such key components in the second fan hub 2581, reducing the working life and reliability of the second fan 258 and the prior art of the projector 20.

SUMMARY OF INVENTION

The objective of the invention is to provide a cooling device for projector, to direct hot current directly into fan blades, thereby reducing the temperature of the fan hub, and increasing the working life and reliability of the product.

To achieve the above objective, the present invention involves a light source that provides light to the projector device. With an air duct extending from the light source to a second exhaust fan, so air in the vicinity of the light source is exhausted through the second fan blades and out of the projector, wherein the second exhaust fan comprises a second fan hub and a plurality of second fan blades, the second fan hub being located at a center of the second exhaust fan, the second fan blades respectively connected to a periphery of the second fan hub, thereby the air in the vicinity of the second fan blades in the projector is exhausted through the second fan blades and out of the projector. The air duct is in a closed status at the periphery of the light source, concentrating a direction for exhaustion, and the air outlet is squarely aligned with the second fan blades.

BRIEF DESCRIPTION OF DRAWINGS

For better understanding of the characteristics and technical contents of the present invention, please refer to the following description and drawings.

DETAILED DESCRIPTION

The following description with drawings of the present invention is used for presentation purpose only, not to limit the present invention.

Figure 1:
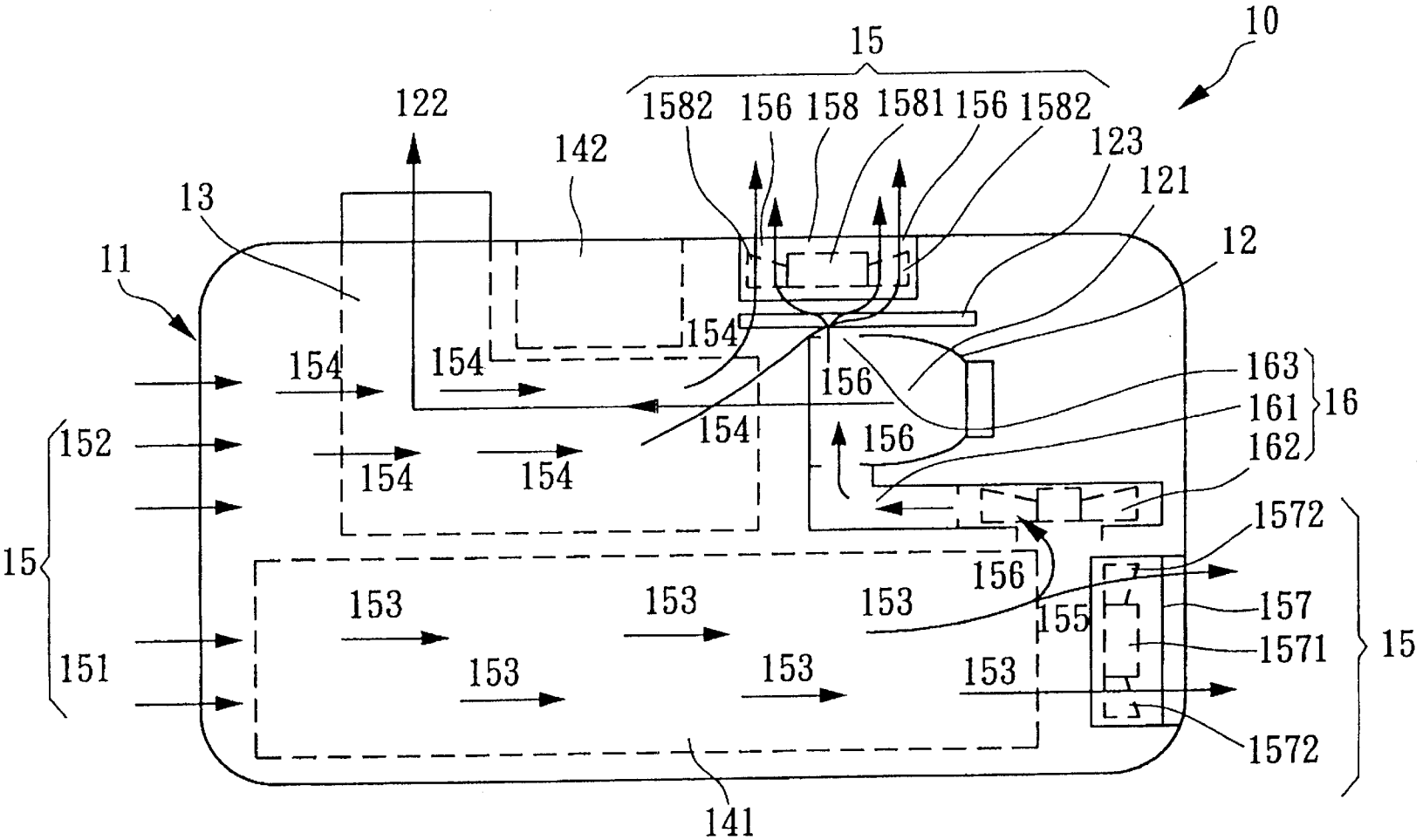
FIG. 1 (PRIOR ART)
FIGS. 1 and 2 are respectively section views of two types of prior art of projector.
Figure 2:
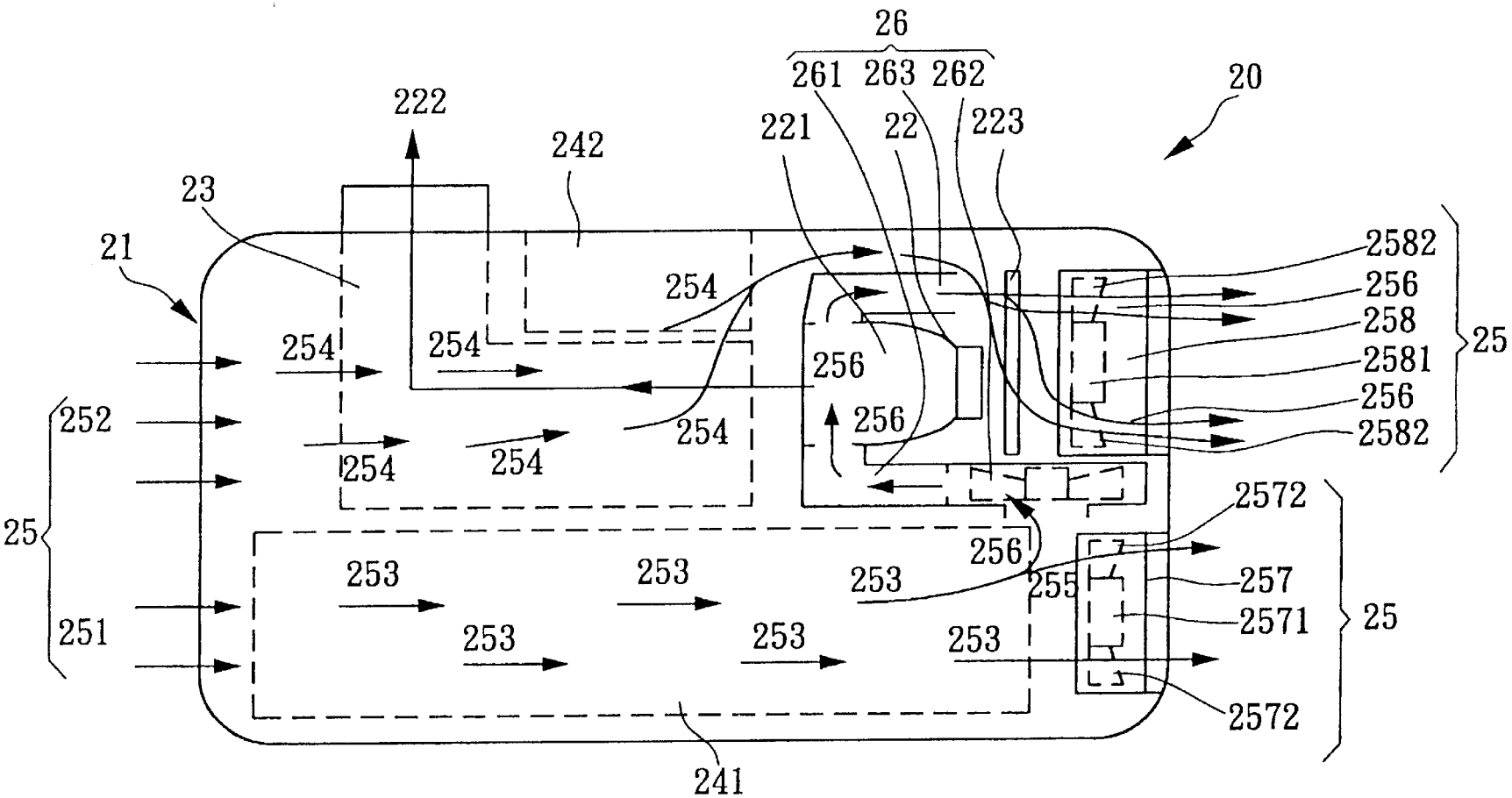
FIG. 2 (PRIOR ART)
Figure 3:
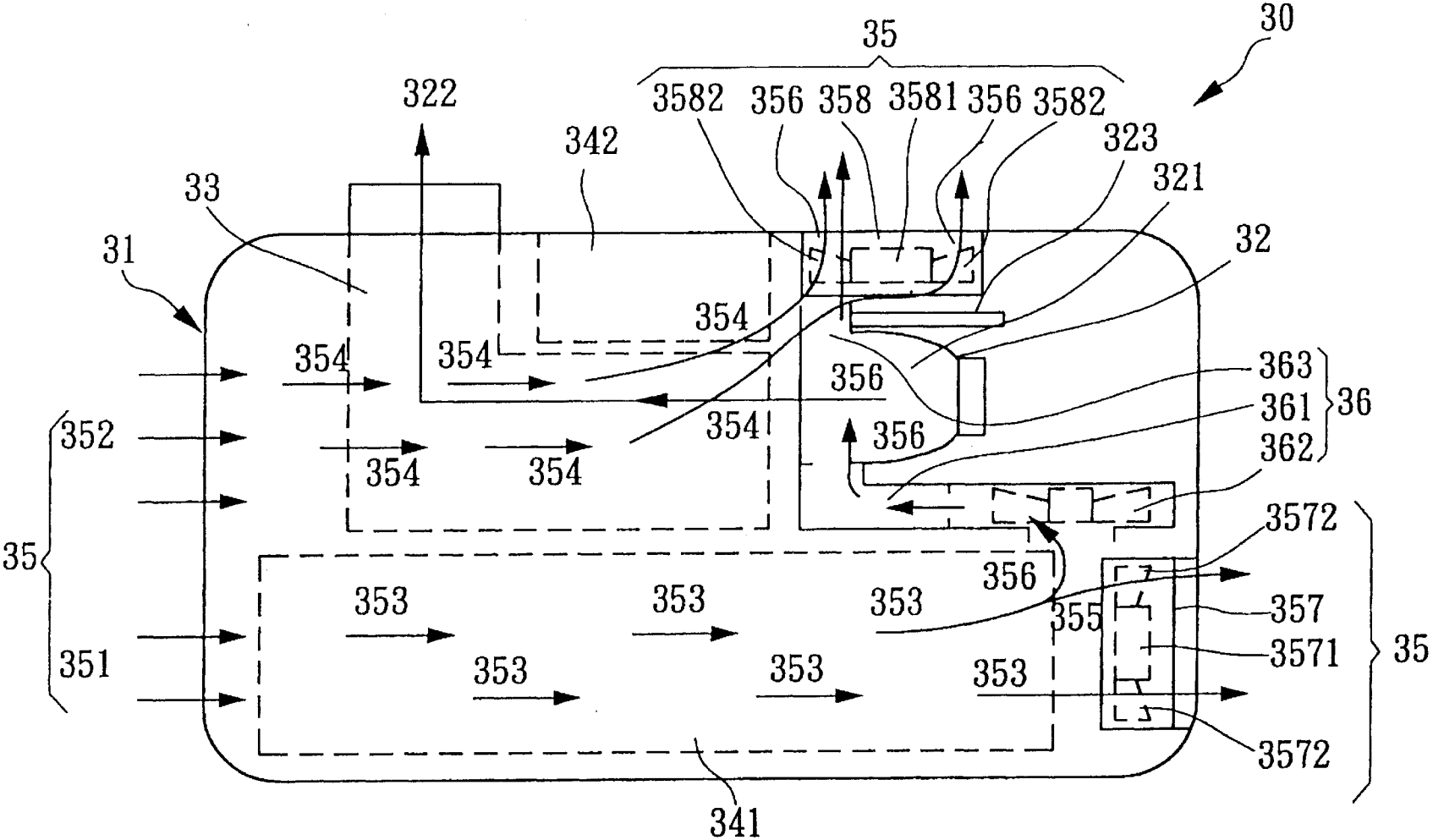
FIGS. 3 and 4 are respectively section views of a first preferred embodiment and a second preferred embodiment of the present invention of a cooling device for projector.

As shown in FIG. 3 that shows a first preferred embodiment of the present invention of projector 30, comprising a light source 321 of a lighting unit 32 inside a casing 31, producing byway of action of an optical engine 33 a high-brightness and high-contrast projector light ray 322. On a side of the lighting unit 32 is installed a light cut 323 that serves to obstruct the light source 321 of the lighting unit 32. The projector 30 further comprises a first printed circuit board 341, a second printed circuit board 342 and a power supply (not shown in drawing), providing power and control to the projector 30. The light source 321, the first printed circuit board 341, the second printed circuit board 342, the optical engine 33 and the power supply generate heat during their operation.

The projector 30 provides exhausting heat by means of a cooling device 35. The cooling device 35 comprises a plurality of first air inlet windows 351 and a plurality of second air inlet windows 352, where cooling air entering through the first air inlet windows 351 or the second air inlet windows 352 into the projector 30 from outside the projector 30. A first fan 357 for ventilation purpose is installed at an opening on the housing 31 at a lower right corner of the projector 30, having a first fan hub 3571 and a plurality of first fan blades 3572, to exhaust hot air out of the projector 30. Between the housing 31 and the light cut 323, a second fan 358 for ventilation purpose is installed at an opening on a housing 31 at an upper part of the projector 30, having a second fan hub 3581 and a plurality of second fan blades 3582 to expire hot air out of the projector 30, and a light source heat exhausting unit 35, consisting of an air duct 361 surrounding the light source 321, comprises a third fan 362 and an air outlet 363, the third fan 362 being an air guide fan installed at an inlet of the air duct 361, with a direction of air entrance at one side of the first fan 357, a part of the heated air in the vicinity of the first fan 357 and the third fan 362 is expired through the first fan 357 out of the projector 30, while another part thereof is guided into the light source heat exhausting unit 36 through the third fan 362.

The heated air in the first preferred embodiment of the invention flows in a direction as described in the following sequence. The air entering through the second air inlet windows 352 into the projector 30 is sucked by the second fan 358, producing a second hot current 354, the second hot current 354 passes respectively the operating optical engine 33, the second printed circuit board 342 and the lighting unit 32, with temperature rising gradually, then through the second fan blades 3582 of the second fan 358 and out of the projector 30. On the other hand, the air entering through the first air inlet windows 351 into the projector 30 is sucked by the first fan 357, producing a first hot current 353, the first current 353 passes the periphery of the first printed circuit board 341 before it is divided into two parts, a third hot current 355 and a fourth hot current 356. The third hot current 355 passing through the first fan 357 and out of the projector 30, and the fourth hot current 356 passes through the third fan 362 and into the light source heat exhausting unit 36. On the other hand, due to the suction by the second fan 358, the fourth hot current 356 entering the light source heat exhausting unit 36 through the third fan 362 enters an inlet of the air duct 361 to reach the light source 321, absorbing the heat generated by the lighting source 321, when temperature rises rapidly. After passing through the light cut 323, the fourth hot current 356 is aligned with the second fan 358, and is then sucked by the second fan 358 out of the projector 30. The air outlet 363 of the fourth hot current 356 of the invention of projector is aligned with the second fan blade 3582.

Figure 5:
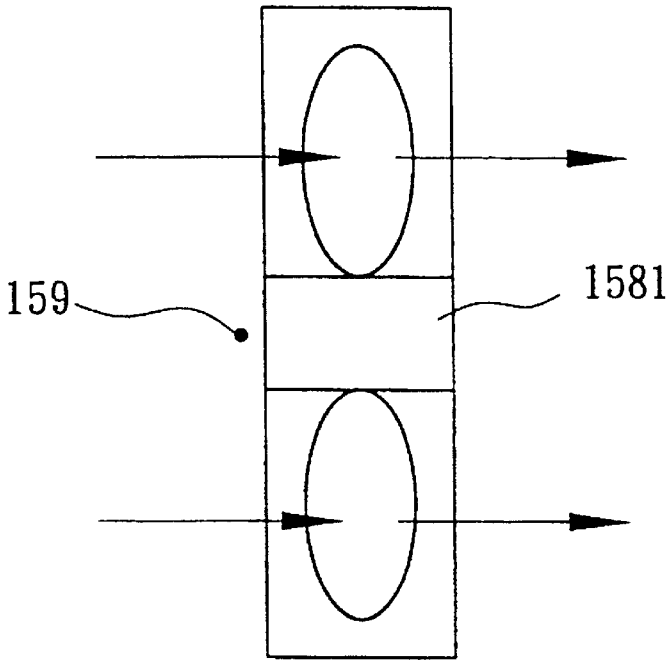
FIG. 5 (PRIOR ART)
FIG. 5 is a schematic view of a position at 1 mm to a front of a center of second fan hub in the prior art.
Figure 6:
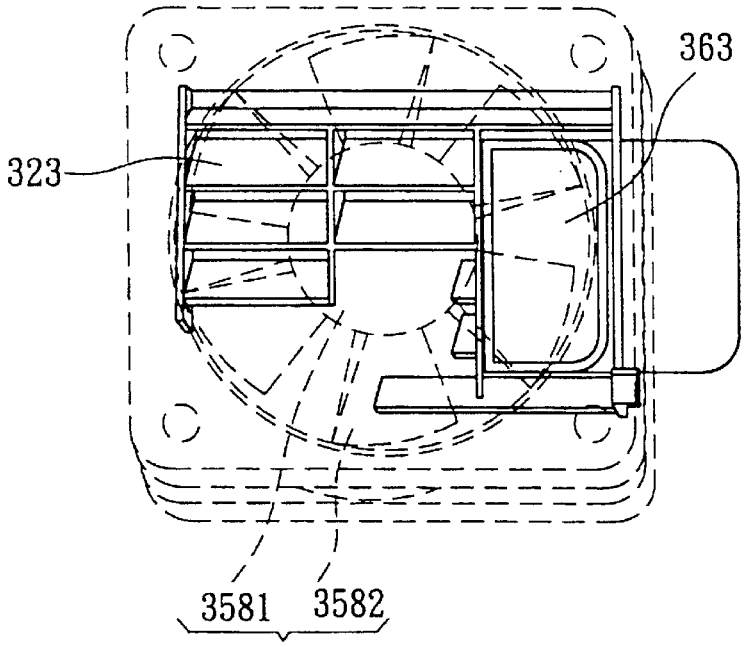
FIG. 6 is view of relationship between a second fan, a light cut and an air outlet in the first preferred embodiment of the invention of a cooling device for projector.

Please refer to FIG. 6, the air outlet 363 disclosed in the present invention of projector 30 is aligned with the second fan blades 3582, at a minimum distance from the second fan blades 3582, so the fourth hot current 356 escaping the air outlet 363 can be directly directed into the second fan blades 3582, and rapidly expulsed from the projector 30. Therefore, at the moment when the fourth hot current 356 escapes the air outlet 363, the fourth current 356 is directed directly to the second fan blades 3582 across a minimum distance, and immediately out of the second fan 358, which effectively solves the problem in the conventional model of projector 10 wherein heat is collected at the front of the second fan hub 1581, thereby reducing the air temperature at 1 mm to the front of the center of the second fan hub 1581 from 206.6 degrees to 174 degrees Fahrenheit, as shown in FIG. 5.

Figure 4:
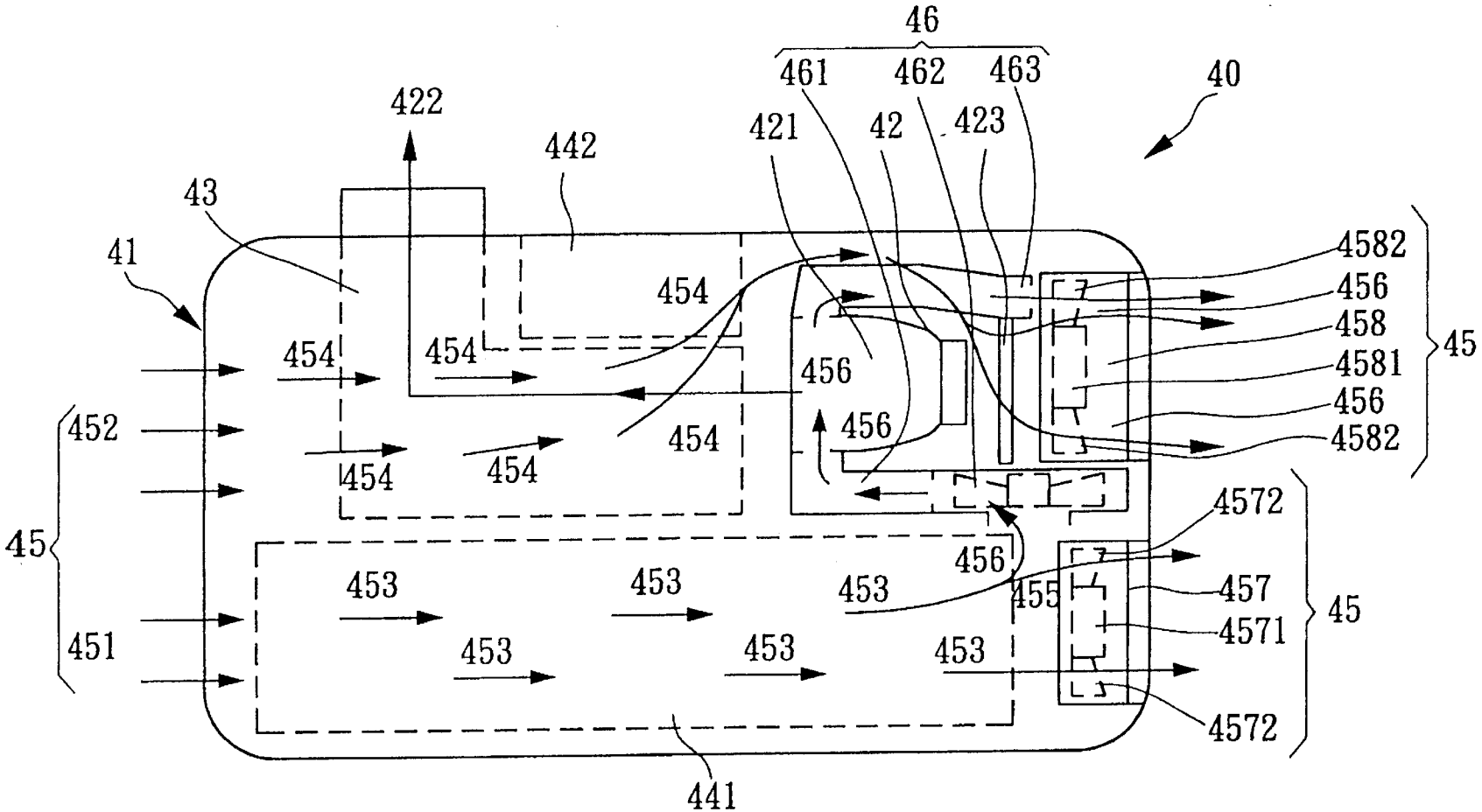
Figure 7:
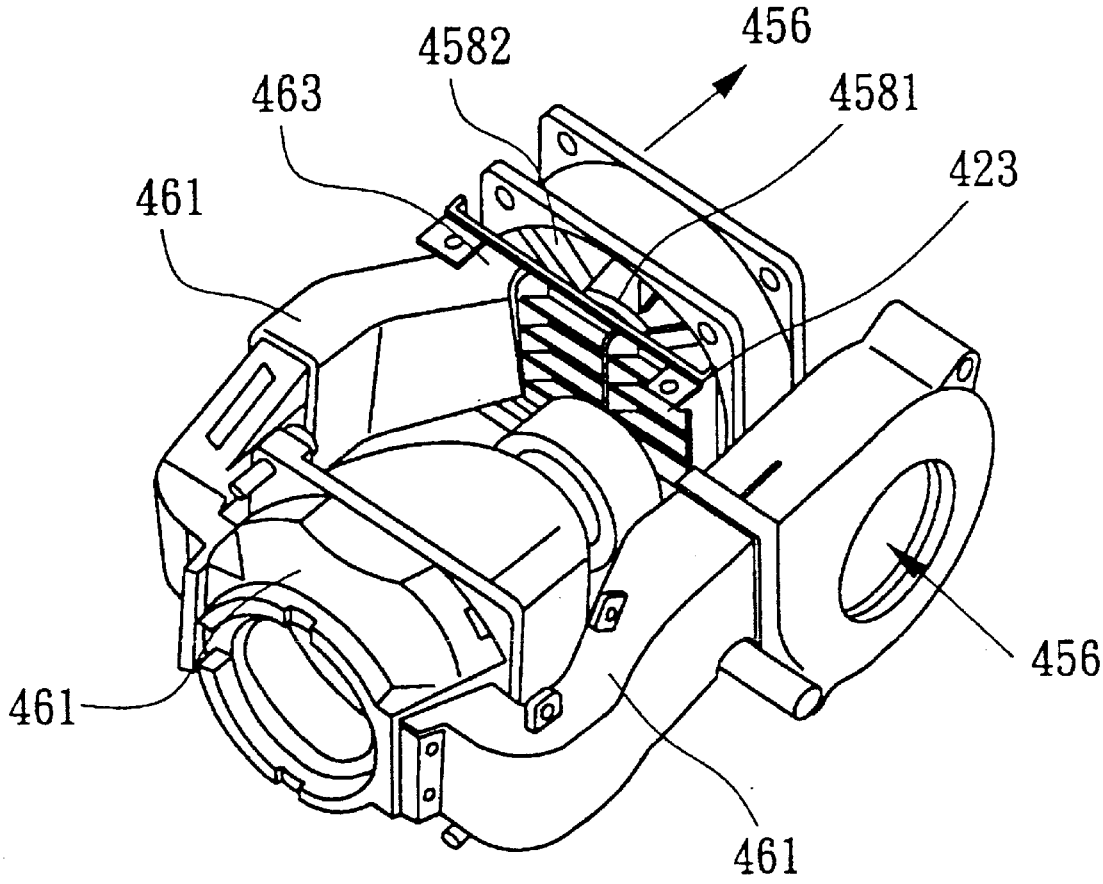
FIG. 7 is a view of relationship between a second fan, a light cut and an air outlet in the second preferred embodiment of the invention of a cooling device for projector.

FIG. 4 illustrates a second preferred embodiment of the invention of projector 40, having a casing 41, a lighting unit 42, a light source 421, an optical engine 43, a light cut 423, a first printed circuit board 441, a second printed circuit board 442, a power supply (not shown in drawing), a cooling device 45, a first air inlet window 451, a second air inlet window 452, a first fan 457, a light source heat exhausting unit 46, an air duct 461, a third fan 462 and an air outlet 463, which are approximately the same as those of the first preferred embodiment of projector 40, with an only difference that the second fan 458 is installed at the rear of the light source 421. Wherein, due to suction of the second fan 458, the fourth hot current 456 directed through the third fan 462 into the light source heat exhausting unit 46 passes the air duct 461, absorbing the heat generated by the light source 421 in heat convection, therefore the rapidly rising temperature. The air duct 461 extends to the right to the rear air duct 462 and passes the light cut 423, as shown in FIG. 7, the air duct 461 in the present invention extends to the right side, the air duct outlet 463 is aligned with the second fan blades 4582, at a minimum distance from the second fan blades 4582, thereby to induct directly the fourth hot current 456 escaping from the air outlet 463 into the second fan blades 4582 and rapidly out of the projector 40. As described above, the present invention has effectively solved the problem of higher average temperature at the front of the second fan hub 2581 where heat is accumulated before passing the second fan blades 2582.

Figure 8:
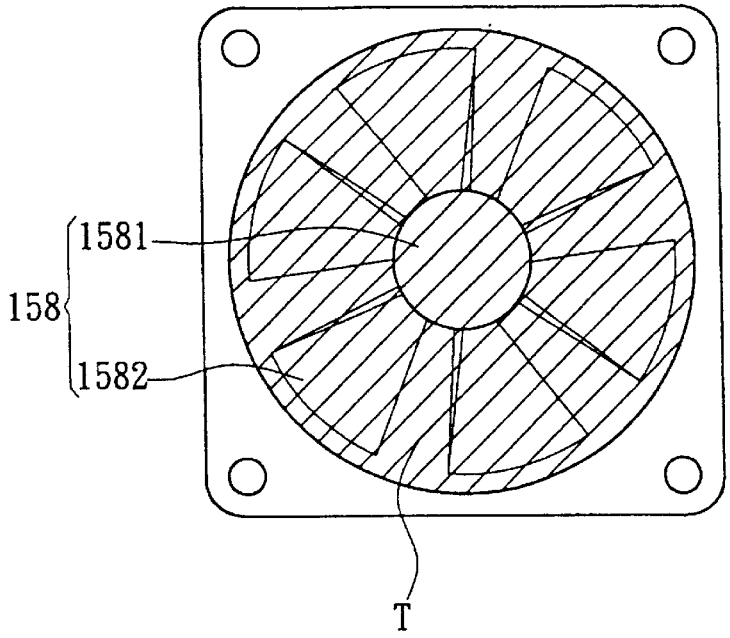
FIG. 8 (PRIOR ART)
FIG. 8 is a view of related temperatures of a second fan including a second fan hub and a plurality of second fan blades, a light cut and an air outlet in the prior art of projector.
Figure 9:
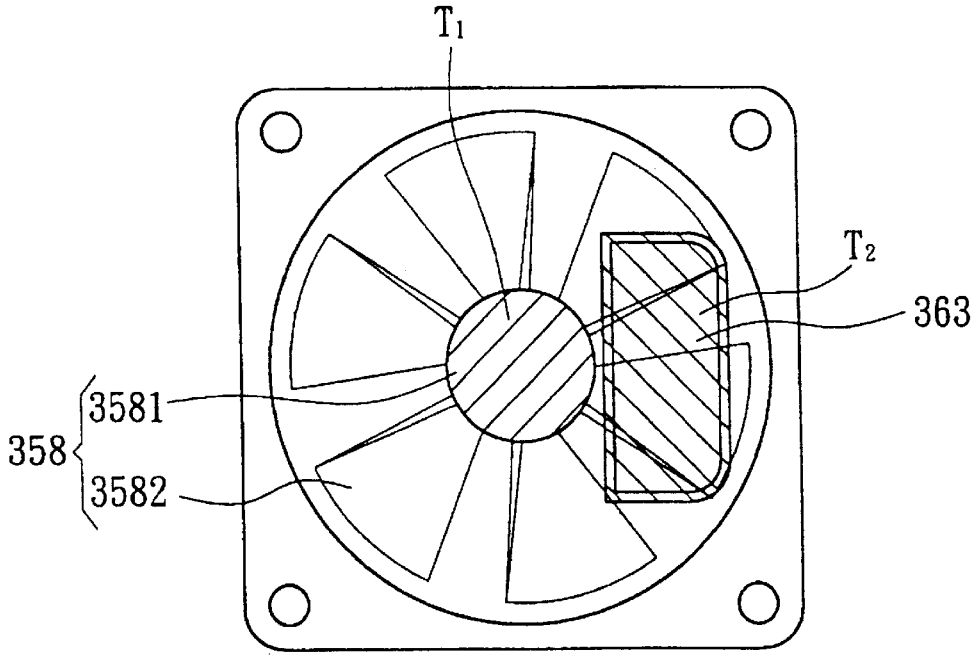
FIG. 9 is a view of related temperatures of a second fan including a second fan hub and a plurality of second fan blades, a light cut and an air outlet in the present invention of a cooling device for projector.

Please refer to FIG. 8 for comparison of temperature distribution between the present invention and the prior art. Take the prior art of projector 10 as an example to see the temperature distribution of the second fan hub 1581. Since the direction of heat radiation of the fourth hot current 156 of the prior art of projector 10 is aligned with the second fan hub 1581, a higher average temperature T occurs in the zone crossed by oblique lines at the front of the second fan hub 1581. As shown in FIG. 9, the present invention of projector 30 is taken as an example, since the air outlet 363 is aligned with the second fan blades 3582, at a minimum distance from the second fan blades 3582, therefore the fourth hot current 356 escaping the air outlet 363 can be directed directly into the second fan blades 3582, and rapidly out of the projector 30. As a result, temperature is the highest because heat is collected in the region crossed with oblique lines of the second fan blades 3582 squarely aligned with the air outlet 363, having an average temperature of $T_2$. Meanwhile, since the second fan hub 3581 (region crossed with oblique lines) is not aligned with the air outlet 363, the heat is not concentrated, and so the temperature is lower, average temperature at $T_1$.

It is known from the above that, the average temperature T affecting the second fan hub 1581 and the second fan blades 1582, in FIG. 8, is lower than the average temperature $T_2$ affecting the second fan blades 3582, but higher than the average temperature $T_1$ affecting the second fan hub 3581, or $T_1<T<T_2$. In other words, the present invention discloses the characteristic of the air outlet in direct alignment with the second fan blades and a minimum distance (approximately 1 mm~5 mm) between the air outlet and the second fan blades, to enable direct induction of the fourth hot current escaping the air outlet into the second fan blades and quickly out of the projector 40. What is disclosed by the present invention is that, high heat and high temperature $T_2$ is collected in the heat-resistant zone of the second fan blades, causing the average temperature $T_1$ of the second fan hub to drop to the average temperature T affecting the second fan hub in the prior art, thereby reducing the operating temperature of motor bearings, control circuits, rotors, stators and such key components in the fan hub, so there will be no adverse effects caused by high temperature, so as to increase the effective life and reliability of the fans and the device.

Figure 10:
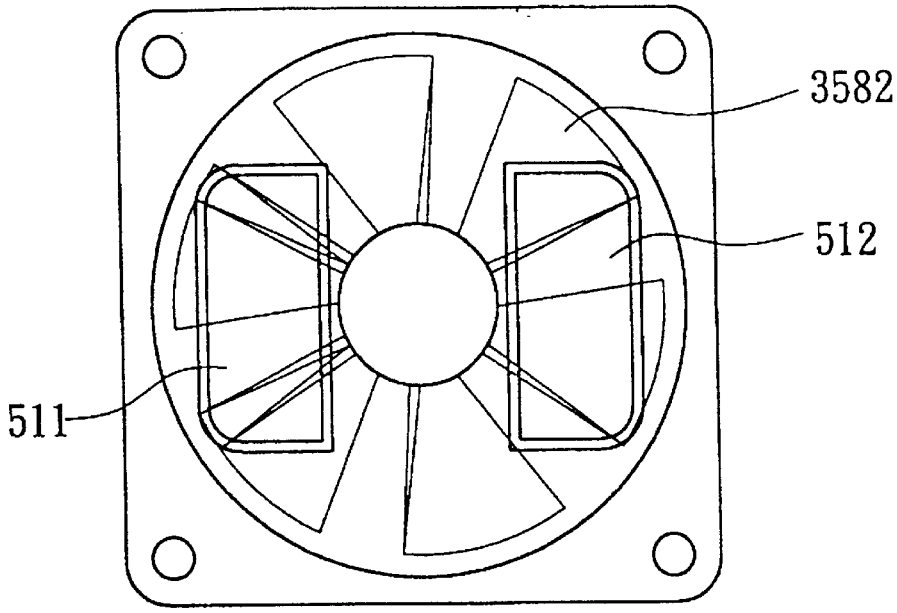
FIG. 10 is a view of a third preferred embodiment of the present invention including two air outlets.

Please refer to FIG. 10 that illustrates a third preferred embodiment of the prevent invention of projector comprising two air outlets 511, 512, each aligned with the second fan blades 3582.

Figure 11:
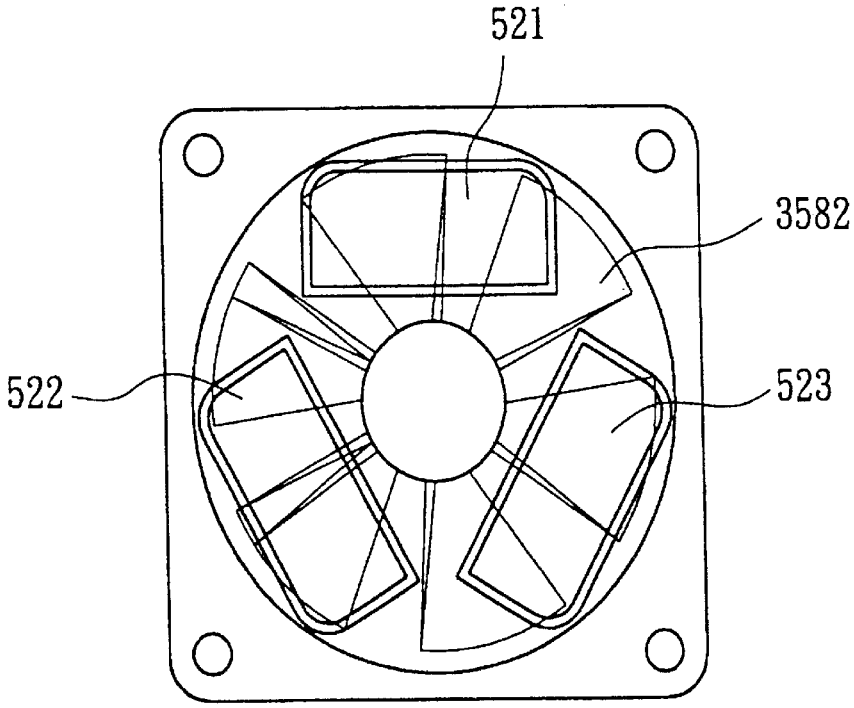
FIG. 11 is a view of a fourth preferred embodiment of the present invention including three air outlets.

Please refer to FIG. 11 that illustrates a fourth preferred embodiment of the present invention of projector comprising three air outlets 521, 522, 523, each aligned with the second fan blades 3582.

Figure 12:
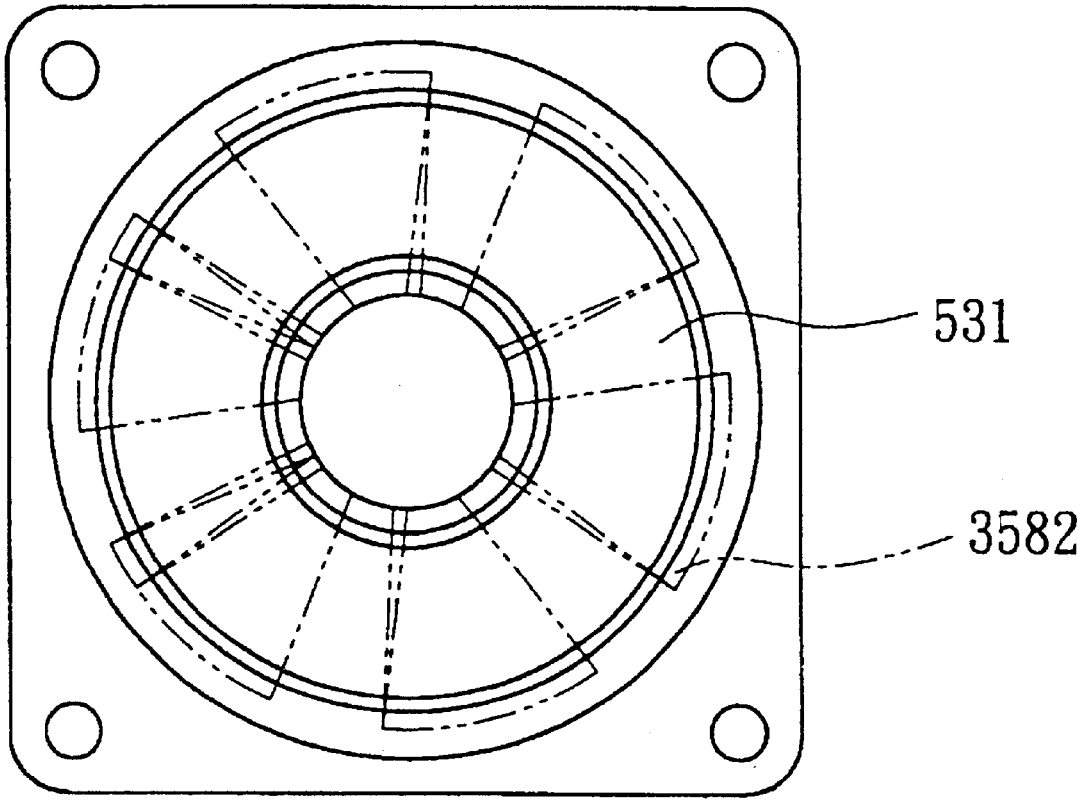
FIG. 12 is a view of a fifth preferred embodiment of the present invention including a ring-shaped air outlet.

Please refer to FIG. 12 that illustrates a fifth preferred embodiment of the present invention of projector comprising a ring-shaped air outlet 531, the ring-shaped air outlet 531 aligned with the second fan blades 3582.

It is to be understood that the above description covering some of the preferred embodiments of the present invention shall not be based to restrict or limit the range of applicability of the present invention, and that all modifications or variations made without departing from the spirit of the invention shall be included in the subject claim. Furthermore, the invention has not been seen in any public occasions or publications, therefore, having satisfied the requirements of "applicability, novelty and inventive step" this application is filed for a patent right. Your favorable consideration will be appreciated.

What is claimed is:

1. A cooling device for a projector, comprising:

a light source, providing light to a projector;

a second exhaust fan, comprising a second fan hub and a plurality of second fan blades, said second fan hub being installed at a center of the second exhaust fan, the second fan blades being respectively connected to a periphery of the second fan hub, the second fan hub controlling the second fan blades to rotate, exhausting air from the vicinity of the second fan blades inside the projector through the second fan blades to the outside of the projector; and an air duct, extending at least from the light source to the second exhaust fan, exhausting air from the vicinity of the light source through the second fan blades to the outside of the projector;

characterized in that, the air duct is in a closed status and is positioned adjacent to a periphery of the light source to concentrate the direction of exhausted air, and the outlet of the air duct is squarely and exclusively aligned with the second fan blades.

2. The cooling device for projector of claim 1, wherein there is at least one of the air duct, each being aligned with the second fan blades.

3. The cooling device for projector of claim 2, wherein the outlet is a ring-shaped air outlet.

4. The cooling device for projector of claim 1, wherein there is a minimum distance between the air outlet and the second fan blades.

5. The cooling device for projector of claim 1, further comprising at least one light cut which is installed between the air duct and the fan blades of a first fan.

6. The cooling device for projector of claim 1, wherein an inlet of the duct comprises a third fan for air induction.

* * * * *